United States Patent [19]

Milholen et al.

[11] 4,245,974

[45] Jan. 20, 1981

[54] BRICK HANDLING APPARATUS

[75] Inventors: William F. Milholen, Siler City, N.C.; Hall Gilliland, Owosso, Mich.

[73] Assignee: Michigan Brick, Inc., Corunna, Mich.

[21] Appl. No.: 26,538

[22] Filed: Apr. 2, 1979

[51] Int. Cl.[3] ..... B28B 11/14

[52] U.S. Cl. ..... 425/308; 264/148

[58] Field of Search ..... 264/148, 157; 425/307, 425/308

[56] References Cited

U.S. PATENT DOCUMENTS

| | | | |
|---|---|---|---|
| 3,461,196 | 8/1969 | Bowles | 264/157 |
| 3,468,998 | 9/1969 | Lingl | 264/157 |
| 3,602,963 | 9/1971 | Lingl | 264/157 |

*Primary Examiner*—John Parrish

*Attorney, Agent, or Firm*—Reed, Smith, Shaw & McClay

[57] ABSTRACT

A brick making machine in which brick material is extruded through a narrow die into a column which is then cut into bricks. Material handling apparatus then stacks the bricks in vertical columns on a pallet.

7 Claims, 4 Drawing Figures

BRICK HANDLING APPARATUS

BACKGROUND OF THE INVENTION

1. Field of the Invention

The present invention relates to brick manufacturing equipment and, more particularly, to apparatus for handling bricks prior to firing.

2. Description of the Prior Art

Bricks have long been a versatile building material. Generally they are made of clay or shale. However, when used for special applications such as paving or refractory materials, the clay or shale is usually supplemented with other materials such as slag, cement, or lime. Usually, such special-purpose bricks are refered to by descriptive names such as fire-brick or sand-lime brick.

In the manufacture of bricks, selected clay soil is throughly ground and mixed with water. This mixture is then "fired" or heated in a controlled manner to produce finished bricks. For many years, the bricks were formed individually by placing the unheated mixture in moulds and then firing the bricks in a kiln. Generally, the bricks were made with manual labor throughout the process.

Currently, however the brick-making process has become more mechanized. The clay is ground and mixed with water in batching machines, extruded through a die, and wire-cut to the selected size. Typical equipment for extruding and cutting clay material into bricks is such as is manufactured by Pearne & Lacy Machine Company, Forrest Pascal Machinery Company, and Lingl Corporation. After the bricks are cut, they are dried and stacked for firing in a kiln. Although much of the process is now mechanized, stacking the bricks for firing in the furnace is still done by manual labor. Usually, a continuously fired kiln is used in which the bricks are passed slowly through the kiln on a conveyor.

Bricks produced by prior methods and equipment typically have dimensions of approximately 2.25 inches by 4 inches by 8 inches. More recently, a new type of brick has been developed that is assembled in a brickwork to provide an ornamental brick veneer. This new type of brick is thinner in that it has dimensions of approximately 2.25 inches by 0.5 inches by 8 inches. It is applied to various surfaces such as concrete blocks, wood paneling, sheetrock, and metal by bonding the bricks to the surface with an adhesive. The completed brickwork provides an attractive, ornamental veneer surface for various applications such as walls, fireplaces, kitchens, room dividers, and planters. Previously, these thin bricks were made simply by cutting a thin face off of a standard brick with a conventual rotating reel cutter prior to firing.

In brick-making operations in general, the process of manually handling the cut bricks prior to firing in the kiln has been relatively slow and expensive. In particular, manually handling the more recently developed thin, decorative bricks prior to firing in the kiln has required considerably care because they are much thinner and more delicate than conventionally sized bricks. Therefore, handling of the unfired decorative bricks has been even more time consuming and expensive than in the case for conventionally sized bricks. Accordingly, there existed a need for material handling equipment that could manipulate the unfired cut bricks, especially thin, decorative bricks, such that the bricks could be arranged for firing in a kiln.

SUMMARY OF THE INVENTION

In accordance with the present invention, brick handling apparatus includes a stacker plate that supports a multiple of bricks arranged in a linear array and moves the bricks in a lateral direction. A pusher assembly having a hinged extension cooperates with the stacker plate such that, when the stacker plate moves in a laterally advancing direction, the extension is in a first position, and when the stacker plate moves in a laterally retracting direction, the extension is in a second position. An elevator that supports a pallet is vertically indexed in response to the movement of the stacker plate such that the bricks are received onto the pallet from the stacker plate in vertical stacks.

Preferably, the pusher assembly further includes a rigid portion that is laterally controlled together with the extension by an actuating member to laterally arrange the stack of bricks on the pallet.

Also preferably, the position of the extension is controlled by a second actuating member that is connected to the extension and to the rigid portion such that, when said second actuating member is in a retracted state, the extension is in the first position, and when said second actuating member is in extended state, the extension is in the second position.

Other details, objects, and advantages of the invention will become apparent as the description of a presently preferred embodiment thereof and a presently preferred method of practicing the same proceeds.

DESCRIPTION OF THE DRAWINGS

The accompanying drawings show a presently preferred embodiment of the invention and illustrate a presently preferred method of practicing the same in which.

DESCRIPTION OF THE PREFERRED EMBODIMENT

Figure 1:
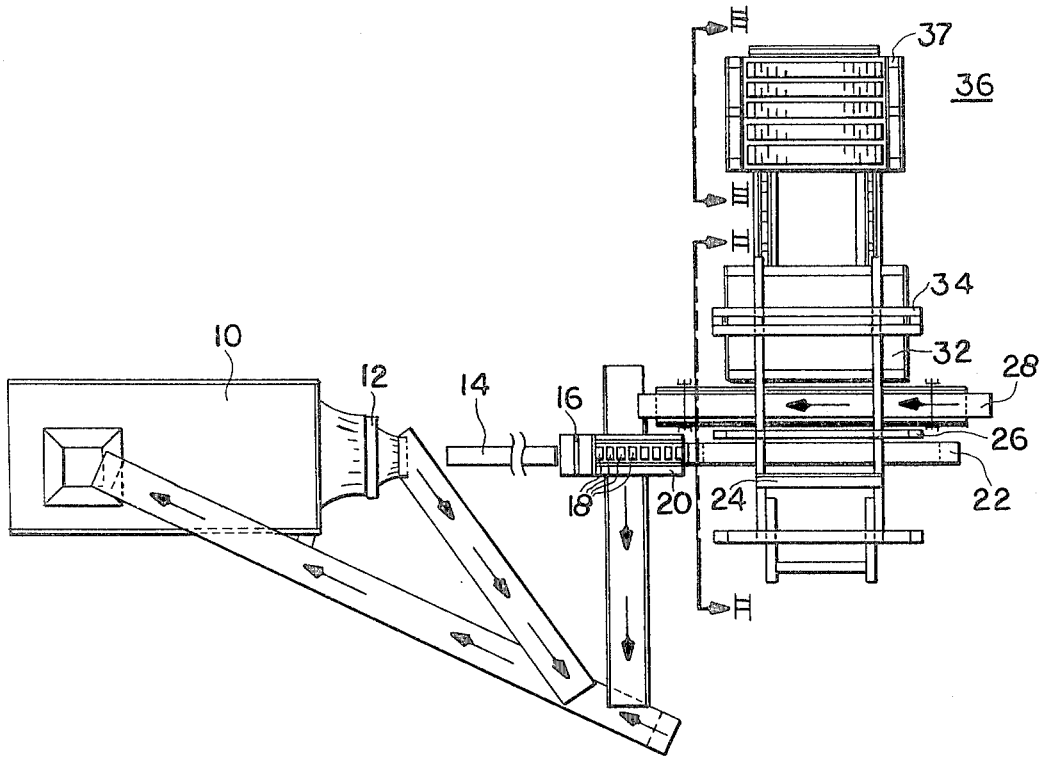
FIG. 1 is a view of apparatus for extruding, cutting, and stacking bricks in accordance with the present invention.
Figure 2:
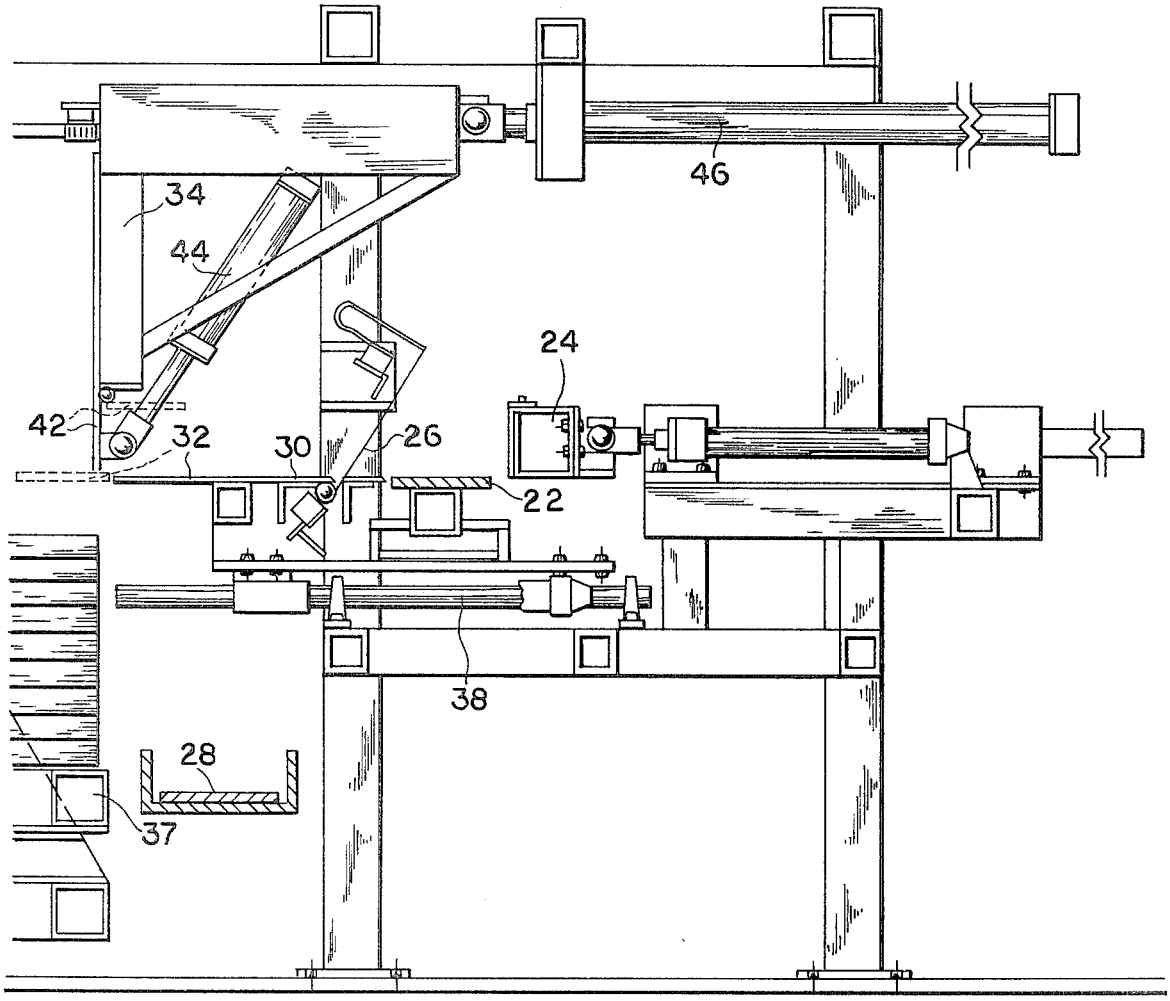
FIG. 2 is a partial cross-section of the brick making apparatus of FIG. 1 taken along the line II—II.
Figure 3:
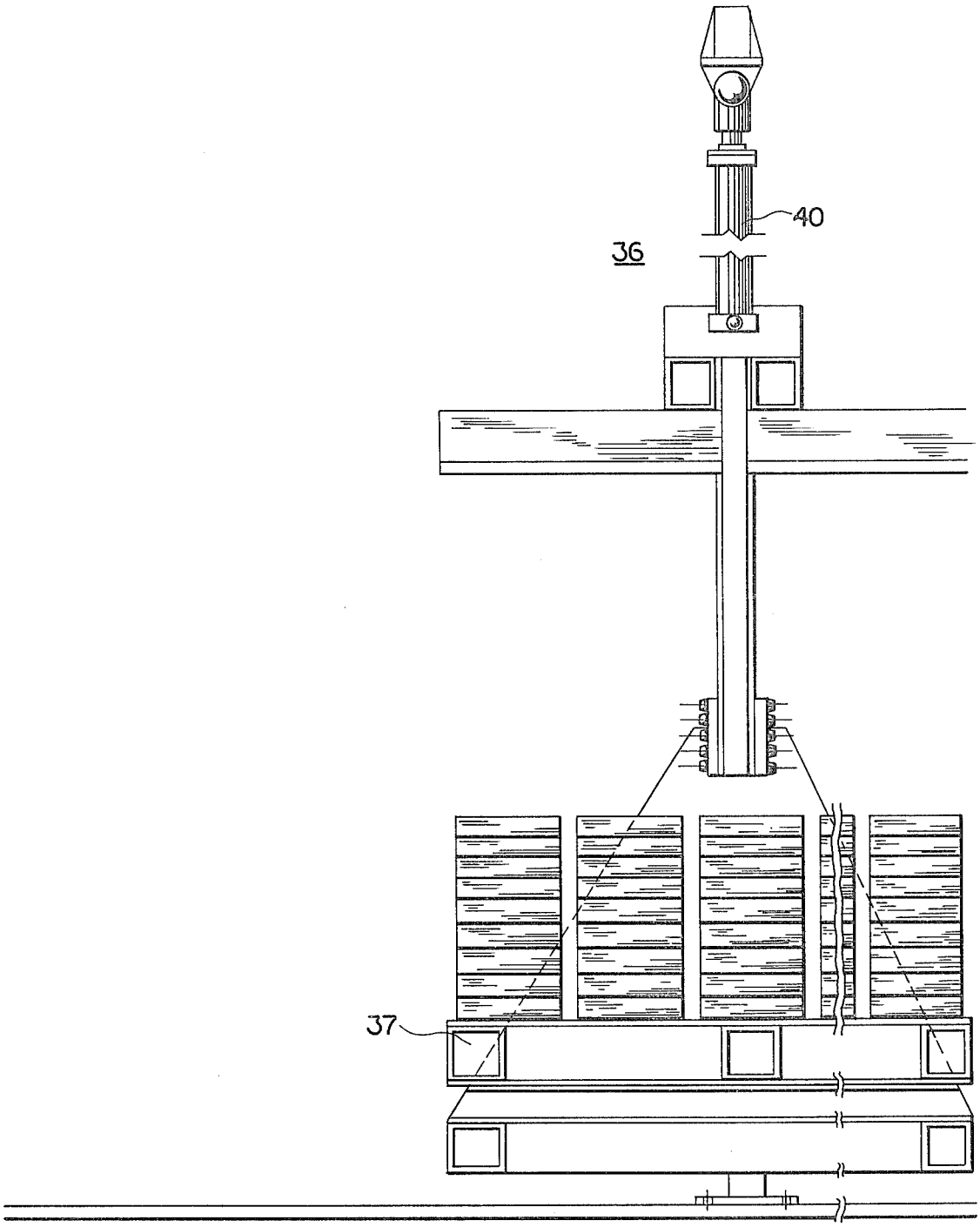
FIG. 3 is another partial cross-section of the brick making apparatus of FIG. 1 taken along the line III—III.

As shown in FIGS. 1-3, the preferred embodiment of the present invention includes a combination pugmill and extruder 10 that extrudes brick making material through a die 12. The brick making material can be comprised of any brick making composition. Preferably, however, brick making material includes a composition of clay or shale.

The die 12 is dimensioned such that the brick making material extruded therethrough comprises a thin, ribbon-like column of material 14. Preferably, the smallest cross-sectional dimension of the die aperature is no greater than 0.5 inch. (1.27 cm). Typically, the cross-sectional dimensions of the die apparatus are 0.5 in (1.27 cm) by 8 in (20.32 cm).

The column 14 of brick making material is forced over a slide conveyor having side guide rollers that direct the column along the conveyor to a shear 16. Shear 16 cuts through column 14 in a controlled manner to separate column 14 into segments 18 of extruded brick making material having a selected length that is determined by the operation of shear 16. From shear 16, the segments 18 are successively conveyed by a roller conveyor 20 and a powered belt conveyor 22. The speed of belt conveyor 22 is sufficiently faster than the linear rate of extrusion of the column 14 such that segments 18 are taken up by belt conveyor 22 individually. That is, each segment 18 carried on belt conveyor 22 is removed by a pusher 24 before belt conveyor 22 begins conveying the succeeding segment 18.

The pusher 24 operates to force the segments 18 laterally off belt conveyor 22 and into a bank of cutter wires 26. As each segment 18 is forced through cutter wire bank 26, it is divided into a multiple of bricks aligned in a row. In the preferred embodiment, cutter wire bank 26 includes an array of twenty wires such that a row is comprised of nineteen bricks. Preferably, pusher 24 is provided with a platen face that extends through the wires of cutter wire bank 26 such that the wires of cutter wire bank 26 are forced completely through segment 18. Although the segments 18 could be any selected length as determined by the operation of shear 16, it is preferred that shear 16 cut segments 18 such that the length is slightly greater than the distance between the distal wires of cutter wire bank 26 as measured along its longitudial axis. In this way, a segment 18 can be centered along cutter wire bank 26 and a full row of bricks produced for each action of pusher 24 with a minimal amount of waste resulting from the loss of the end portions of segment 18. Preferably, the wires of cutter wire bank 26 are laterally spaced by a distance equivalent to the width dimension of the bricks such that cutter wire bank 26 divides each segment 18 into a row of nineteen bricks laterally arranged and supported on the side of their largest cross-sectional dimension. Also preferably, a scrap conveyor 28 (FIG. 1) is provided for catching the end portions of segment 18 and returning them to pugmill and extruder 10 for recycling.

The rows of bricks produced from cutter wire bank 26 are forced onto a receiving table 30 (FIG. 2) by pusher 24 where they are supported until they are forced laterally onto a stacker plate 32 (FIG. 2) by operation of pusher 24 in forcing the succeeding segment 18 through cutter wire bank 26.

In accordance with the present invention, stacker plate 32 cooperates with a pusher 34 to successively place the rows of bricks on a roller conveyor (not shown). Preferably, however, stacker plate 32 cooperates with pusher 34 and an elevator 36 to arrange the rows of bricks cut by cutter wire bank 26 in vertical columns. Preferably, a pallet 37 is placed on the base of elevator 36 to facilitate removing the columns of bricks from elevator 36 and placing them in a kiln for firing. Specifically, stacker plate 32 is horizontally moveable between a first position in which it is adjacent receiving table 30 as shown in FIG. 2 in solid lines, and a second position in which it extends vertically above pallet 37 located on elevator 36 as shown in FIG. 2 in dashed lines.

In addition, pusher 34 is provided with a hinged flipper arm 42 that is controlled by a hydraulic cylinder 44. When hydraulic cylinder 44 is retracted, flipper arm 42 is in a first position in which it is rotated in the direction of receiving table 30 out of the plane of the face of pusher 34 as shown by dashed lines of FIG. 2 such that a row of bricks on stacker plate 32 can be moved freely past the vertical plane of the face of pusher 34. When hydraulic cylinder 44 is in the extended position, flipper arm 42 is in a second position in which the major surface of flipper arm 42 is substantially in the vertical plane of the face of pusher 34 as shown by the solid lines in FIG. 2. The action of hydraulic cylinder 44 in controlling flipper arm 42 is synchronized with the action of hydraulic cylinder 38 which controls stacker plate 32 such that hydraulic cylinder 44 is retracted and flipper arm 42 is folded back at times when hydraulic cylincder 38 is extending and stacker plate 32 is being moved from a position adjacent receiving table 30 to a position vertically above pallet 37. Conversely, hydraulic cylinder 44 is extended and flipper arm 42 is substantially in the vertical plane of pusher 34 at times when hydraulic cylinder 38 is retracting and stacker plate 32 is being moved from a position vertically above pallet 37 to a position adjacent receiving table 30. The cooperation of flipper arm 42 and hydraulic cylinder 44 with stacker plate 32 and hydraulic cylinder 38 is such that the rows of bricks that are placed on stacker plate 32 from receiving table 30 are carried to a position vertically adjacent pallet 37 and then removed from stacker plate 32 by the action of flipper arm 42 against the bricks as stacker plate 32 is being returned to a position adjacent receiving table 30.

The lateral position of stacker plate 32 is controlled by hydraulic cylinder 38 and the vertical position of elevator 36 is controlled by hydraulic cylinder 40 such that elevator 40 is vertically indexed in accordance with the operation of stacker plate 32. Specifically, each time hydraulic cylinder 38 is extended and then retracted such that stacker plate 32 is extended vertically above pallet 37 and then retracted to a position adjacent receiving table 30, hydraulic cylinder 40 retracts by a distance substantially equal to the height of the bricks thus vertically indexing the position of pallet 37. In addition, the vertical indexing of elevator 36 in accordance with the operation of stacker plate 32 results in the rows of bricks being arranged in vertical columns as they are removed from stacker plate 30.

In one example of the operation of the present invention, brick making material having a composition of clay and shale is placed in pugmill and extruder 10 and extruded through die 12 to provide a ribbon-like column of extruded material 14 having cross-sectional dimensions of substantially 9/16 in (1.43 cm) by 8 in (20.32 cm). The ribbon-like column of material is carried by a slide conveyor to shear 16 where it is divided into segments 18. Segments 18 are carried by roller conveyor 20 and belt conveyor 22 to a position laterally adjacent the bank of cutter wires 26. Pusher 24 then extends to force each segment 18 laterally through the bank of cutter wires 26 to provide a row of nineteen bricks on receiving table 30. The end portions of segment 18 are collected by scrap conveyor 28 and returned to pugmill and extruder 10. The row of 19 bricks remains on receiving table 30 until the next segment 18 is forced through cutter wire 26 by pusher 24 to form a succeeding row of 19 bricks on receiving table 30. As the succeeding row of bricks is placed on receiving table 30, the previous row of bricks is forced onto stacker plate 32.

The rows of bricks produced in this manner are stacked onto pallet 37 from stacker plate 32 by vertically positioning elevator 36 such that the top surface of pallet 37 is adjacent the lower edge of flipper arm 42 and horizontally parallel to the underside of stacker plate 32. With hydraulic cylinder 44 in a retracted position such that flipper arm 42 is in its first position, hydraulic cylinder 38 is extended to advance stacker plate 32 vertically above elevator 36. Since flipper arm 42 is in the first position, the bricks on stacker plate 32 are not disturbed.

After hydraulic cylinder 38 is extended and stacker plate 32 is vertically above pallet 37, hydraulic cylinder 44 is extended to place flipper arm in its second position such that stacker plate 32 can no longer be moved between its first and second positions without disturbing any bricks thereon. Hydraulic cylinder 38 is then retracted to return stacker plate 32 to its first position adjacent receiving table 30 thereby causing the bricks to be laterally forced off of stacker plate 32 by flipper arm 42. Stacker plate 32 and flipper arm 42 thereafter cooperate in a similar manner to convey the rows of bricks to elevator 36.

The rows of bricks forced from stacker plate 32 by flipper arm 42 may be allowed to merely fall onto a continuously moving conveyor (not shown) or, alternatively, into pallet 37. However, it is preferred that the bricks be stacked in columns on pallet 37. Accordingly, the vertical position of elevator 36, as controlled by hydraulic cylinder 40, is controlled with respect to each cycle of operation of stacker plate 32 such that elevator 36 is indexed downwardly by a distance substantially the thickness of one brick. Therefore, each row of bricks forced from stacker plate 32 by flipper arm 42 is placed on top of the previous row of bricks until a column of a selected height is attained.

When a column of selected height has been developed by controlling the vertical position of elevator 36 in coordination with the operation of stacker plate 32, flipper arm 42 is placed in its second position and the vertical position of elevator 36 is returned to its initial position in which pallet 37 is adjacent the lower edge of flipper arm 42. The column of bricks is then horizontally indexed to a selected location on pallet 37 by pusher 34. The above operation is then resumed with the rows of bricks being vertically and horizontally indexed in a similar manner until pallet 37 is filled. For the presently preferred example, pallet 37 will be considered to have a capacity of five columns of bricks. When five columns of bricks have been placed on pallet 37, the pallet is removed from elevator 36 and taken to a kiln where the bricks are further processed.

Figure 4:
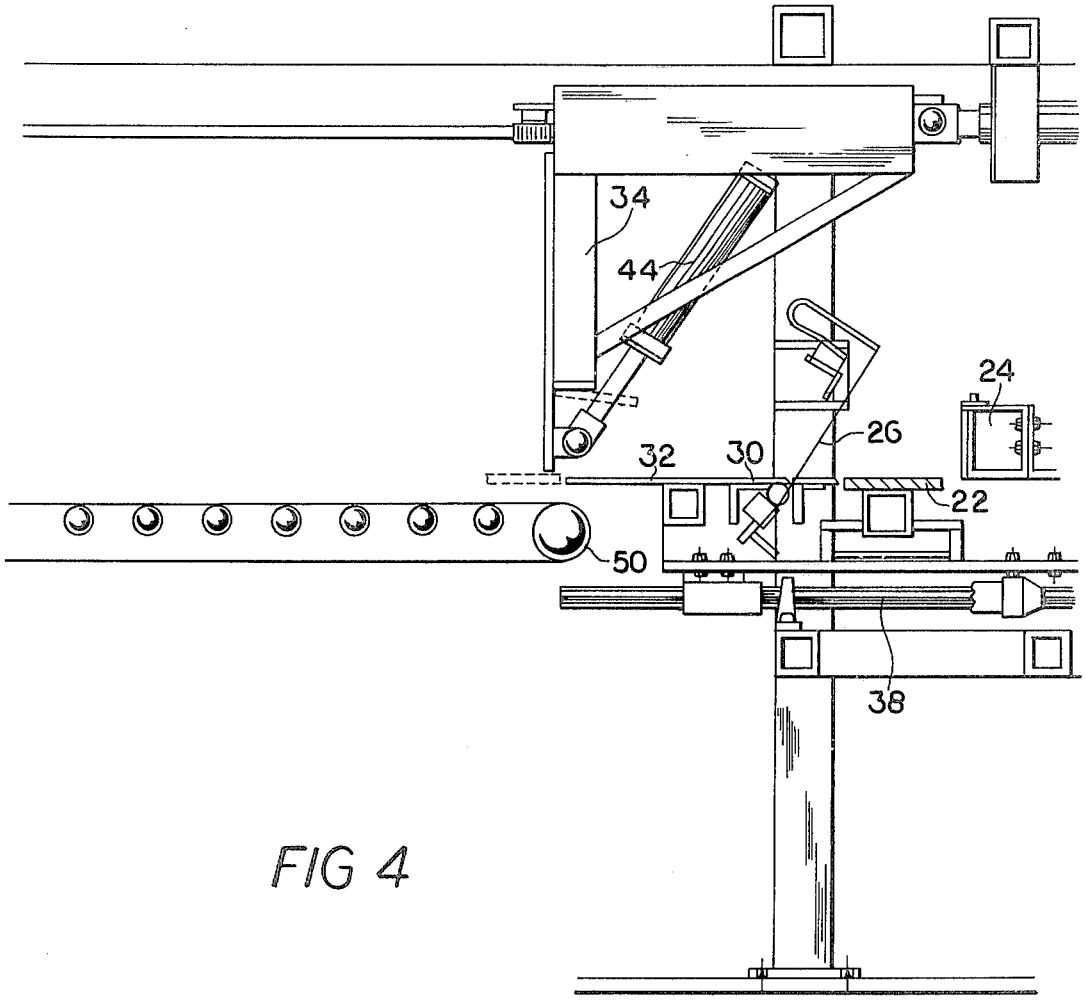
FIG. 4 shows an alternative embodiment of the invention in which bricks are provided in a continuous manner.

In an alternative embodiment shown in FIG. 4, hydraulic cylinder 46 is absent and a powered roller convey 50 replaces the combination of hydraulic cylinder 40, elevator 36, and pallet 37 shown in FIG. 3. In this embodiment, like numbered parts are similar and operate in the manner described with respect to FIGS. 1–3 except that, although pusher 34 still includes flipper arm 42 and hydraulic cylinder 44 that operate in conjunction with stacker plate 32 and hydraulic cylinder 38 to remove bricks from stacker plate 32 as previously described, pusher 34 no longer has capability for lateral movement. In this sense, pusher 34 does not operate as a pushing member but, rather, as a structural support member from which flipper arm 42 depends. Accordingly, pusher 34 could be replaced by a somewhat simplified and functionally equivalent structural member.

The alternative embodiment of FIG. 4 does not vertically and horizontally index the brick rows as does the embodiment of FIGS. 1–3, nor are any columns of the brick rows established. Rather, the embodiment of FIG. 4 is intended for continuous operation in which the rows of brick are conveyed to roller conveyor 50. This mode of operation is continuous and without need for intervention by a human operator to attend to the machine at times such as when pallet 37 of the embodiment of FIGS. 1–3 is full and must be removed from elevator 36 and replaced with an empty pallet. While the embodiment of FIG. 4 offers the advantages of continuous operation, it requires compatible apparatus for drying and firing the bricks. For example, roller conveyor 50 would feed the bricks directly to a roller hearth dryer and kiln for drying and firing of the bricks.

While certain presently preferred embodiments of the invention have been shown and described and certain presently preferred methods of practicing the same have been illustrated, it is to be understood that the invention is not limited thereto but may be otherwise variously embodied within the scope of the following claims.

I claim:

1. Material handling apparatus for use in making bricks said apparatus comprising:

a stacker plate for supporting a plurality of bricks and laterally moving them in a controlled manner;

a pusher assembly having a hinged extension that is in a first position when the stacker plate moves in one lateral direction, and that is in a second position when the stacker plate moves in the opposite lateral direction, said pusher assembly cooperating with said stacker plate to remove bricks from the stacker plate as it moves in the opposite direction; and an elevator that is vertically indexed in response to the movement of the stacker plate such that the bricks removed from the stacker plate are arranged in a vertical, columnar arrangement.

2. The material handling apparatus of claim 1 wherein said pusher assembly is laterally moveable to control the lateral position of the brick columns.

3. Brick handling apparatus for cutting bricks from a column of extruded material and arranging the bricks in vertical columns on a pallet, said apparatus comprising:

shear apparatus for separating the extruded material into segments of selected length;

a cutter assembly for dividing each of the segments into a plurality of bricks;

a stacker plate for supporting a plurality of bricks and moving them laterally with respect to the cutter assembly;

a pusher assembly having a hinged extension that is in a first position when the stacker plate moves in a laterally advancing direction, and that is in a second position when the stacker plate moves in a laterally returning direction, said pusher assembly cooperating with the stacker plate to remove the bricks from the stacker plate when the hinged extension is in the second position; and an elevator that supports the pallet and that is vertically indexed in response to the lateral movement of the stacker plate such that the pallet receives the bricks from the stacker plate in vertically columnar arrangement.

4. The brick handling apparatus of claim 3 wherein said pusher assembly includes a rigid portion that is connected to said hinged extension and that cooperates with said hinged extension to laterally position a column of bricks on said pallet.

5. The brick handling apparatus of claim 4 wherein said pusher assembly includes means for actuating said pusher assembly in a lateral direction, said actuating means being interlocked with the vertical movement of said elevator.

6. The brick handling apparatus of claim 5 wherein said pusher assembly includes a second actuating means connected to said extension and to said rigid portion such that said extension is in the first position when the second actuating means is in a retracted state and in the second position when the second actuating means is in an extended state.

7. The apparatus of claim 3 further comprising:

means for extruding brick making material through a die to form a column of brick making material, the aperature of said die having a smallest dimension in the range of 0.25 inch to 0.75 inch.

* * * * *